US007187357B1

(12) United States Patent
Vogel et al.

(10) Patent No.: US 7,187,357 B1
(45) Date of Patent: Mar. 6, 2007

(54) DEVICE FOR ENTERING VALUES USING A DISPLAY SCREEN

(75) Inventors: Martin Vogel, Sargans (CH); René Wussler, Regensdorf (CH)

(73) Assignee: Studer Professional Audio AG, Regensdorf (CH)

( * ) Notice: Subject to any disclaimer, the term of this patent is extended or adjusted under 35 U.S.C. 154(b) by 0 days.

(21) Appl. No.: 09/807,445

(22) PCT Filed: Oct. 21, 1999

(86) PCT No.: PCT/CH99/00498

§ 371 (c)(1),
(2), (4) Date: May 23, 2001

(87) PCT Pub. No.: WO00/25532

PCT Pub. Date: May 4, 2000

(30) Foreign Application Priority Data

Oct. 26, 1998 (CH) ..... 2153/98

(51) Int. Cl.
*G09G 5/00* (2006.01)

(52) U.S. Cl. ..... 345/156; 345/172; 345/173; 345/184

(58) Field of Classification Search ..... 345/156, 345/161, 171–173, 160, 169, 184, 716, 727, 345/771, 764, 905, 926.1
See application file for complete search history.

(56) References Cited

U.S. PATENT DOCUMENTS 5,339,166 A * 8/1994 LeBrat et al. ..... 386/54
5,402,501 A * 3/1995 Silfvajt et al. ..... 381/119
5,517,320 A * 5/1996 Schuler ..... 386/46
5,524,060 A * 6/1996 Silfvast et al. ..... 381/104
5,572,239 A 11/1996 Jaeger
5,712,661 A 1/1998 Jaeger
5,774,115 A 6/1998 Jaeger et al.
5,777,603 A 7/1998 Jaeger
5,786,811 A * 7/1998 Jaeger ..... 345/172
5,801,942 A * 9/1998 Nixon et al. ..... 700/83
5,805,145 A 9/1998 Jaeger
5,805,146 A 9/1998 Jaeger et al.
5,818,941 A * 10/1998 Embree ..... 381/22

(Continued)

FOREIGN PATENT DOCUMENTS

EP 0782091 7/1997

*Primary Examiner*—Richard Hjerpe
*Assistant Examiner*—Leonid Shapiro
(74) *Attorney, Agent, or Firm*—Brinks Hofer Gilson & Lione

(57) ABSTRACT

Device for setting values for processing audio signals includes a signal processor, at least two elements for manually entering and/or adjusting the values, a carrier for the at least two elements, and a screen for displaying the entered and/or adjusted values. The screen includes at least two fields. The at least two elements and the carrier are located in front of the screen. A computer, coupled to the at least two elements via connections in front of the screen, acquires the entered and/or adjusted values and displays the acquired value on at least one of the at least two fields. The computer is coupled to the signal processor for processing of audio signals and to transmit control commands to the signal processor for processing the audio signals according to the manually entered and/or adjusted values established by the at least two elements.

22 Claims, 6 Drawing Sheets

U.S. PATENT DOCUMENTS 5,841,428 A 11/1998 Jaeger et al.
5,859,631 A * 1/1999 Bergman et al. ..... 345/173
5,930,375 A * 7/1999 East et al. ..... 381/119
5,936,613 A 8/1999 Jaeger et al.
5,940,521 A * 8/1999 East et al. ..... 381/119
5,959,610 A * 9/1999 Silfvast ..... 345/156
5,977,955 A 11/1999 Jaeger
5,982,355 A 11/1999 Jaeger et al.
6,061,458 A * 5/2000 East et al. ..... 381/119
6,359,632 B1 * 3/2002 Eastty et al. ..... 345/716
6,438,241 B1 * 8/2002 Silfvast et al. ..... 381/119

* cited by examiner

DEVICE FOR ENTERING VALUES USING A DISPLAY SCREEN

CROSS-REFERENCE TO RELATED APPLICATIONS

The present application is a U.S. National Stage Application of International Application No. PCT/CH99/00498 filed Oct. 21, 1999, which claims priority of Swiss Patent Application No. 2153/98, filed Oct. 26, 1998.

BACKGROUND OF THE INVENTION

1. Field of the Invention

The invention relates to a device for entering values with a screen for displaying values and with at least one element for manual entry of the values provided in front of the screen.

2. Discussion of the Background Information

Devices for the input of values are, e.g., rotating knobs and sliding levers that are connected to a dial from which the adjusted value can be read. Here, the feedback about the adjusted value is quickly recognizable and easy to survey. Such systems are well introduced and require little space. Unfortunately, however, they cannot be configured, i.e., they cannot easily and quickly be reassigned to another task. Nor can they be operated by remote control. This disadvantage can be avoided by connecting a motor which moves the rotating knob or sliding lever. Such devices are known, but are expensive and large.

In a further developmental stage, the device for entering can be separated from the display so that the rotating knob or the sliding lever and the display screen, which can also be embodied as a monitor, are locally separated. Such a device can be configured and controlled remotely. However, the operation is less advantageous since, if several such devices are provided in a tight area, the coordination between the entering element and the display element must be known or practiced. Frequently, the elements for the entering of values are locally separated so far from the display of the values that a correlation between the element and the display is not always ensured. Frequently, so many entry elements are provided that confusion is inevitable. For such types of devices, audio mixers are typical for sound signals, control panels for power plants or chemical arrangements, as well as operating surfaces for devices for medicinal technology, etc.

Another known embodiment for such devices with a screen is known from the technology of electronic computers, so-called PC's. Here, an arrow can be directed onto a field on the screen by a so-called mouse where, e.g., a value can be selected from a given selection of values. Or, originating from a given value, the next given value can be selected by an impulse from the mouse. Such an embodiment can be configured and controlled remotely, but it is comparatively slow in its operation. The lack of a directly acting entering knob leads to an awkward operation. The simultaneous operation of several entering devices is impossible.

Furthermore, devices with screens are known in which the display and value entering occur directly via the screen, i.e., operate without a mouse. On such screens, the program separates fields which, e.g., are to be touched by the finger in order to select one value among several values. Such systems are known by the term "touch screen." They are easy to arrange and configure, and are quicker to operate than a mouse. However, each entry field on the screen requires a lot of space. The operation is perceived as uncomfortable when the operating finger of the hand has to perform a continuous, pushing motion, directed away from the body.

From U.S. Pat. No. 5,572,239, a device is known with control elements, e.g., rotating or sliding knobs being provided in front of a flat screen, which are connected to a transformer via a connecting element, such as a shaft, e.g., which transforms a motion or position of the control element into an electric signal. The transformer is mounted onto a carrier so that ultimately the control elements are positioned on this carrier as well. The carrier is positioned behind the flat screen, viewed in the viewing direction, and the connection to the control elements occurs via openings in the flat screen.

Therefore, in this known device, control elements are positioned in front of the screen and transformers behind the screen that convert the settings of the control elements. This is always contingent upon the connection being made via the screen, i.e., no monitor containing a cathode ray tube can be used. Another disadvantage can be seen in that, by the utilization of control elements and separate transformers, an overall large amount of space is necessary, and the construction of such devices is expensive, in particular the application in an audio mixer.

SUMMARY OF THE INVENTION

Therefore, the present invention provides a device of the above-mentioned type which allows a secure, i.e., reliable and confusion-free, but also quick feedback about values, which can be entered in an ergonomically advantageous manner by means of a manual entry element and provides a constructive design that requires little space and can easily be constructed.

For this purpose, a carrier for the elements for manual entering is positioned in front of the screen, as seen in the viewing direction, in the device according to the invention. Insofar as the carrier covers the entire screen, it is provided with at least one transparent region correlated to the element for the display of values on the screen. The elements are connected by way of connections in front of the screen to the computer which enters the setting of the elements for the manual entering of data and, in at least one region of the screen, a feedback of the adjusted values is displayed. Preferably, an element for mounting electronic components is correlated to the screen and the carrier. The element for mounting electronic components is preferably positioned between the carrier and the screen and, depending on the configuration, is provided with transparent regions at least whenever it covers the entire screen. It can be positioned directly at the carrier as well (e.g., applied as a foil) or be integrated therein. For example, rotating knobs, sliding levers, so-called joy-sticks, etc., i.e., sensors that are adjustable linearly or in two dimensions or directions can be used as entry elements. Such entry elements produce either a value according to their present setting or produce a signal which corresponds to a performed movement and produce increments of processing values, for instance.

The advantages achieved by the invention can be seen in particular in the ability to provide a clear and secure feedback to the operator on recently adjusted values. The frequently present spacial and therefore visual distance as well between the position in which the display occurs on a screen and the position in which a value entering occurs is reduced such that both elements are moved into the same view for display and operation. Thus, depending on the configuration, several displays and several entry elements can be set into the same view so that, e.g., values can be changed simultaneously with both hands and immediately the valid values can be controlled for both entries simultaneously. Additionally, the device according to the invention allows the entering of values in quick sequences and is particularly "handy" or advantageous for operating with hands. When used in audio mixers for sound technology, it adapts to the habits of the sound masters to a large extent and thus supports their work in a positive manner. Due to the control elements being directly connected to the computer via cables and the wires being mounted directly on the screen, a particularly simple construction results demanding little space as well.

In the following, the invention is explained using an exemplary embodiment and figures. They show:

The present invention is directed to a device for setting values for processing of audio signals. The device includes a signal processor, at least two elements structured and arranged for at least one of manually entering and adjusting the values, a carrier for the at least two elements, and a screen for displaying the at least one of entered and adjusted values, the screen including at least two fields. The at least two elements and the carrier are located, relative to a viewing direction of the screen, in front of the screen. A computer is coupled to the at least two elements via connections in front of the screen, and the computer is structured and arranged to acquire the at least one of entered and adjusted values and to display the acquired value on at least one of the at least two fields of the screen. The computer is also coupled to the signal processor for the processing of audio signals and structured and arranged to transmit control commands to the signal processor for processing the audio signals according to the at least one of the manually entered and adjusted values established by the at least two elements.

In accordance with a feature of the invention, set values of the at least one of the manually entered and adjusted values depend upon a position of the at least two elements.

According to another feature of the present invention, the carrier includes transparent regions assigned to the at least two elements.

Further, the computer determines a configuration for the processing of the audio signals in the signal processor.

The device of the instant invention also provides a device for mounting electronic components positioned between the carrier and the screen for mounting electronic components. Further, the device for mounting electronic components is positioned on the carrier.

In accordance with still another feature of the invention, the at least two elements include at least one shaft encoder. Alternatively, or additionally, the at least two elements include at least one linearly adjustable transmitter.

Moreover, the computer is structured and arranged to determine a configuration of the device by detecting positions of the at least two elements.

The device according to present invention further includes additional elements which are different from the at least two elements are associated with the screen.

Further, the computer is structured and arranged to acquire states of the at least two elements via signals in the at least two fields of the screen and to display these states on the screen. The acquired states include signal paths, lever positions, filters, dynamic changing processors, size of signals, position and variation of the position of the at least two elements.

In accordance with a further feature of the invention, at least one of the at least two elements includes an operating element structured and arranged for configuring an audio mixer.

According to still another feature of the invention, at least one of the at least two elements includes an operating element structured and arranged for setting parameters for the processing of the audio signals.

The present invention is directed to an audio signal processing apparatus that includes an operating surface having at least two operating elements structured and arranged to set values related to at least one of a configuration for processing audio signals and parameters for the processing of the audio signals. At least one screen is structured and arranged to display the set values of the at least two operating elements, and a computer, coupled to the at least two operating elements and to the at least one screen, is structured and arranged to acquire the set values and transmit the set values to the at least one screen for display. A signal processor is coupled to the computer, such that the computer transmits the set values to the signal processor to adjust the processing of the audio signals by the signal processor.

According to a feature of the present invention, an algorithm library is coupled to the computer and to the signal processor.

In another feature according to the instant invention, at least one of the operating elements is structured and arranged to define a configuration for the processing of the audio signals. Further, at least one other of the operating elements is structured and arranged to adjust a value of at least one selected parameter without changing the configuration.

Moreover, the apparatus further includes signal paths, positionable levers, filters, modifying processors, and the computer being structured and arranged to acquire data related to states of the signal paths, lever positions, states of the filters, dynamics of the modifying processors, amplitudes of the audio signals, and current positions of the at least two operating elements, and to transmit this data to the at least one screen for display.

In accordance with yet another feature of the present invention, a graphic computer is arranged to couple the computer to the at least one screen.

DETAILED DESCRIPTION OF THE PRESENT INVENTION

Figure 1:
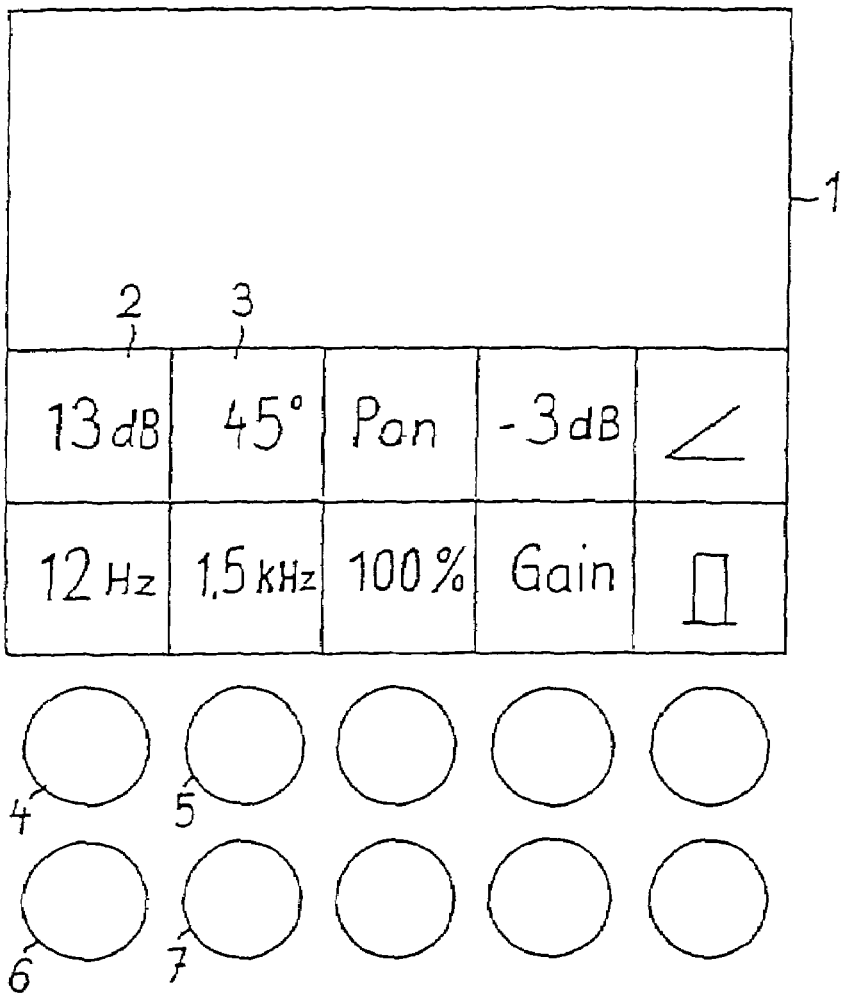
Prior Art Fig.1
FIG. 1 a representation of a device according to prior art

FIG. 1 shows a known embodiment of a device comprising a screen 1 and several fields 2, 3 etc. in which a value is displayed graphically, e.g., in the form of numbers. These two fields 2, 3 are correlated to rotating knobs 4, 5, e.g., by way of which values can be entered into the device. The displayed values in the fields 2, 3 can be modified by rotating the rotating knobs 4, 5. For this purpose, however, it must be known that the fields 2, 3 correspond to the rotating knobs 4, 5 and not to the rotating knobs 6, 7 which could be conceivable as well. In reality, the distance between the fields 2, 3 and the rotating knobs 4, 5, 6, 7, as well as the number of the rotating knobs present can be much larger than shown here, which increases the insecurity during operation.

Figure 2:
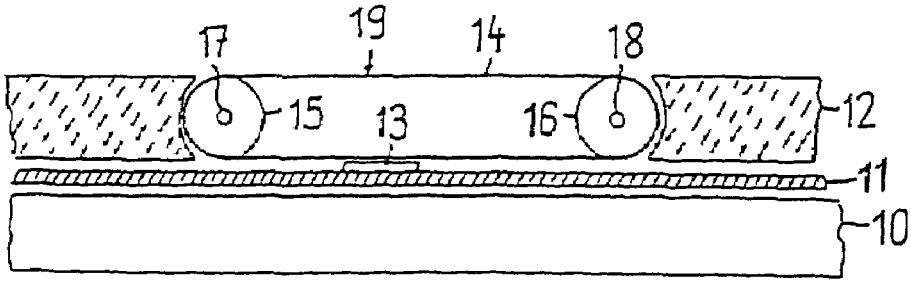
FIG. 2 a section of a part of the device

FIG. 2 shows a section through a part of the device according to the invention. Here, a part of the screen 10, a part of the element 11 for mounting electronic components, and a part of a carrier 12 for elements for entering values are discernible. Here, the element 11 is typically embodied as a printed circuit board on which strip conductors are mounted, here, in particular, an optically operating sensor 13. In this example, the sensor 13 cooperates with a belt 14 which rests on rolls 15, 16 which are positioned in the carrier 12 via the axes 17 and 18. The belt 14 comprises at least one marking initiating an electrical impulse when it is positioned opposite to the sensor 13. In order to enter values, the belt 14 can be moved on its upper side 19, using a finger, for instance. Here, a linear adjustable activator is used. The activator 12 is constructed of a transparent medium such as, for example, glass, plexiglass, mineral glass, etc. and the element 11, cut out in certain regions next to the belt, is clear or not present. The carrier 12 can, e.g., be mounted on a cover sheet for the screen or on a common housing part. An incremental activator is conceivable for the sensor 13, for instance.

In order to enter values, the belt 14 is driven, on its upper side 19 by a finger, for example, and is shifted into a new position with markings on the belt 14 causing impulses in the sensor 13 that are processed into values in a processing unit in a manner that is known per se and therefore not described in detail here. These values are displayed in a region or field by the screen 10, which is next to the belt 14.

Figure 3:
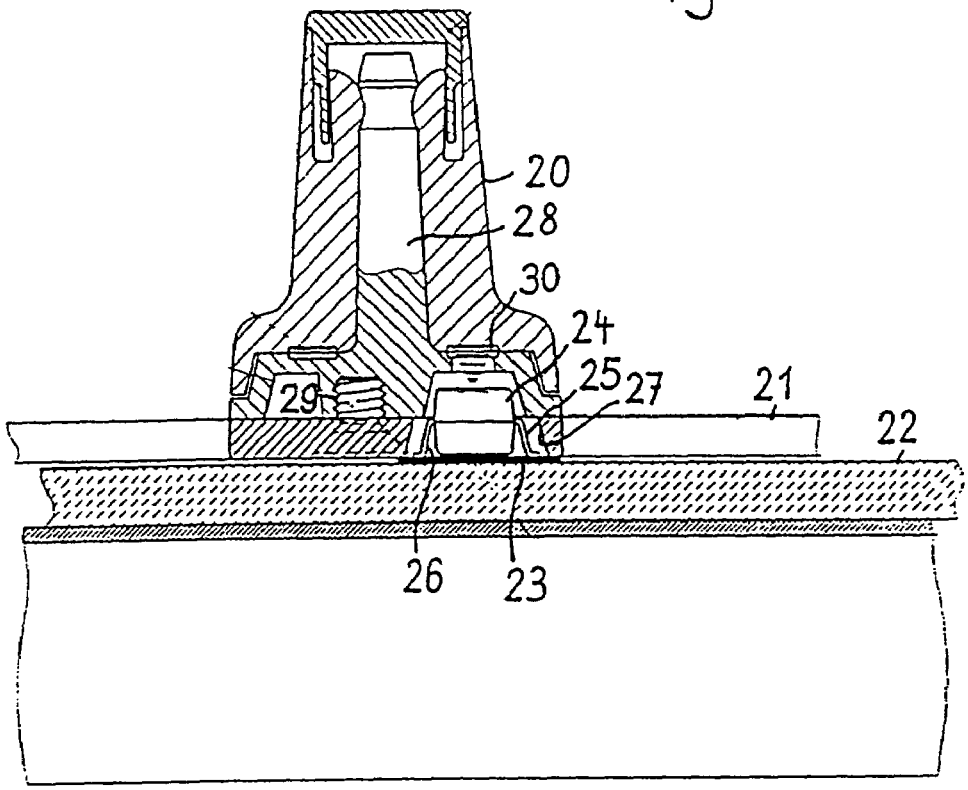
FIGS. 3 and 4 a section each through another embodiment of a part of the device FIG. 5 a view of the device FIG. 6 a detailed view of the device and FIG. 7 a schematic block of the construction of the device with a computer.

FIG. 3 shows another embodiment of the device having a rotating knob 20 as the entry element. Here, in contrast to FIG. 2, another (optical) element, a so-called touch screen, is provided as the screen 22. The rotating knob 20 is positioned in a pivotable manner on the carrier 21 which is positioned in front of the screen 22 and of which only a part is discernible. Between the screen 22 and the carrier 21, an element 23 is provided for mounting electronic components, such as strip conductors, and mounted on one of them. Here, a sensor 24 is mounted via contacts 25, 26 as well. Thus, the carrier 21 is provided with an recess 27. Additional recesses, not shown here, clear the screen. On the carrier 21, a bearing 28 for the rotating knob 20 is mounted via at least one bolted connection 29, as well. On the rotating knob 20, a disc provided with a code is mounted which is in visual contact to an optically operating sensor 24. The construction elements of the company Hewlett-Packard, Type HEDR 8000, for example, are suitable as the sensor 24.

It is also conceivable to position the sensor and the wires leading to it directly on the surface of the carrier and covered by the rotating knob.

For the purpose of entering values, the rotating knob 20 is rotated by hand with the disc 30 following and causing an impulse in the optical sensor 24, which processes the value unit into values in a manner that is known per se and thus is not described in detail here. These values are displayed by the screen 22 in the region or field that is next to the rotating knob 20.

Figure 4:
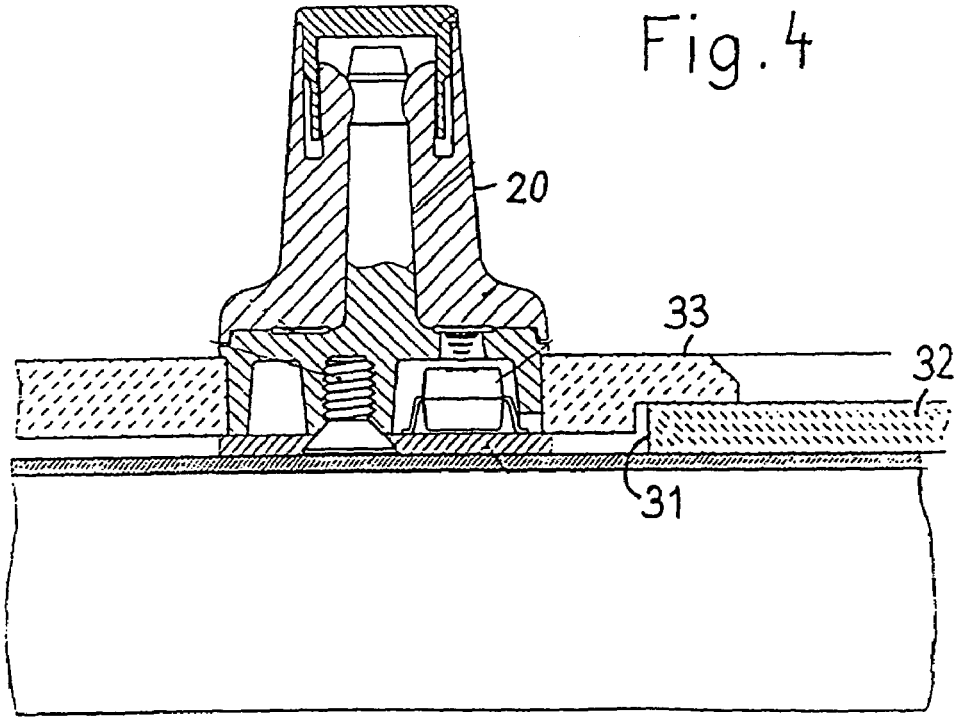

FIG. 4 shows another possible embodiment with the screen 32, here a touch-screen, being mounted with its side wall 31 immediately next to the carrier 33.

According to the invention, sensors can also be used that do not operate optically but use other physical effects such as magnetism, ultrasound, etc.

Figure 5:
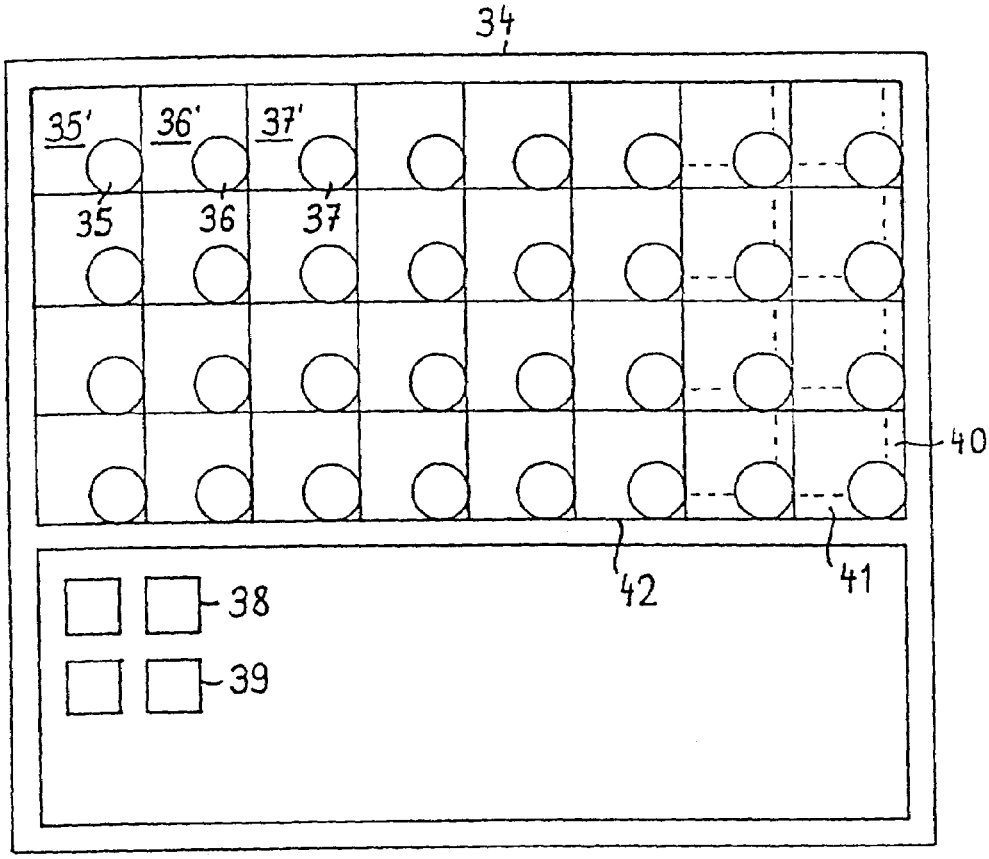

FIG. 5 shows a view of a device according to the invention viewed in the direction towards a screen 34 with regions 35', 36', 37', etc. for displaying adjusted values and rotating knobs 35, 36, 37, etc. being elements for entering values which are assigned to a carrier 42. In addition to the mentioned entry elements, other entry elements, known per se, 38, 39 of a different type can be provided on the same screen, operating with the "touch screen" principle or being activated by a mouse. In general, the carrier 42 can be embodied transparently so that the screen 34, positioned therebehind, is visible in all parts not covered by the rotating knobs 35, 36, 37. However, additional regions 40, 41 of the carrier 42 may be covered by strip conductors, e.g., which are positioned above or below the carrier 42 or are provided as foils or are embodied as thin or thick layers. In these additional regions 40; 41 that may cover the screen in a web-like fashion, connecting all rotating knobs, the screen 34 is covered and therefore not visible.

The device according to the invention is particularly advantageous in so-called LCD screens. They are advantageously provided with an even surface and reflect regions always in the very same size, once their regions are defined by a program. For instance, a dial is always displayed in the same size and at the same position. LED screens are very easily integrated in a horizontal position and form a part of an audio mixer for sound signals, for instance.

Figure 6:
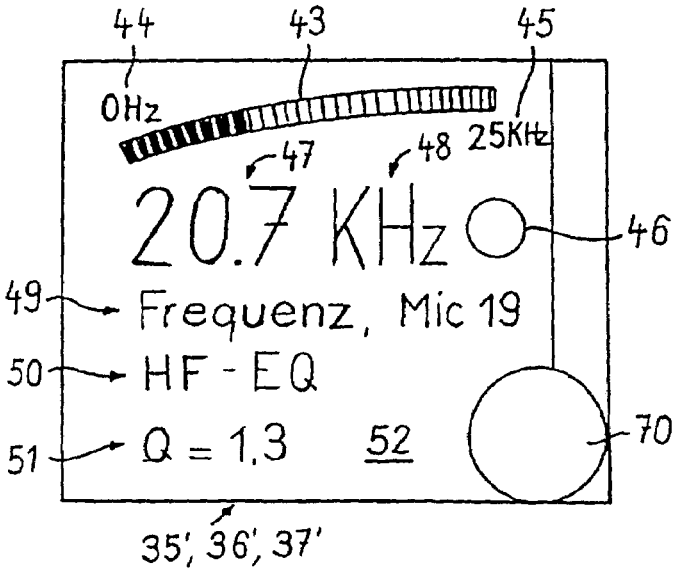

FIG. 6 shows an example of data that may occur in an audio mixer in the regions 35', 36', or 37'. Here, these data are values for an audio-channel for processing signals, for example. 43 identifies a graphic value display with regional specifications 44 and 45. A display concerning a control mode is provided in 46, indicating whether the control occurs automatically or manually. The absolute value of a parameter is indicated in 47 and the measuring unit used in 48. In other places, the name of the parameter set is named in 49, the name of the parameter in 50, and another supplementary display in 51. Additionally, the background color 52 may indicate a parameter identification, a level of alarm, etc.

Figure 7:
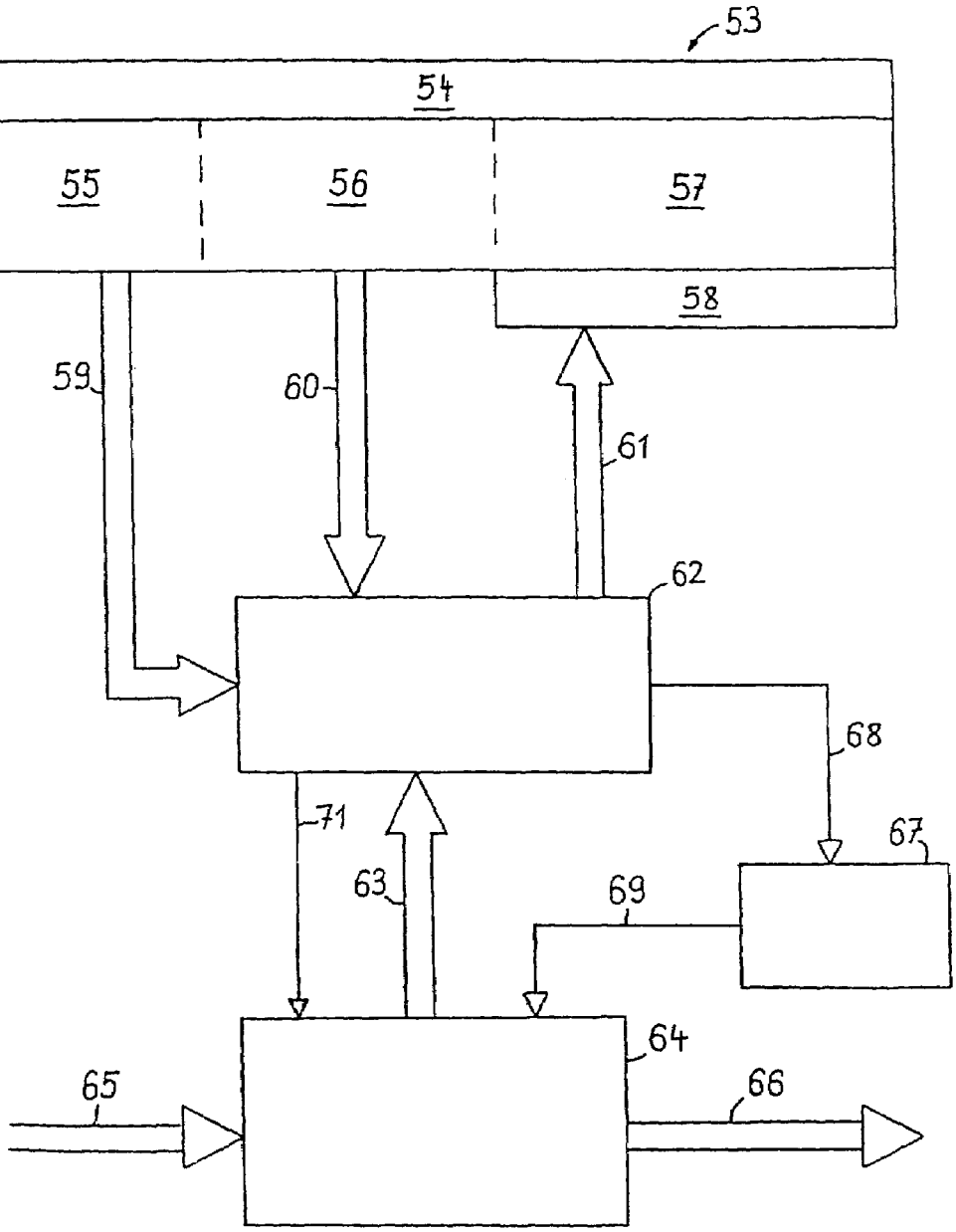

FIG. 7 shows a block wiring diagram of the device according to the invention, here, the conditions for application in an audio mixer are taken into close consideration, by way of example. An operating surface 53 should be provided with a variety of adjustment elements and display elements such as dials, lamps, etc. as customary in such audio mixers. This operating surface includes a carrier 54 for operating elements 55 which serve the configuration of the audio mixer, an operating element 56 which serves to influence parameters important for the processing of audio signals, and one or more screens 57 serving to display values, dials, functions, etc. The graphic computer 58 is connected to the screen as well. A computer 62 is connected to the operating surface 53 via one data bus 59, 60, and 61 each. Here, the data bus 59 transmits data or commands relating to the configuration of the audio mixer or its changes from the operating elements 55 to the computer 62. The data bus 60 provides the computer 62 with new values from the operating elements 56 concerning the parameters for processing the audio signals or the algorithms used. The data bus 61 transmits data relating to the present state of the audio mixer and the audio signals from the computer 62 to the graphic computer 58 and, thus, to the screen 57. The computer 62 is also connected to a signal processor 64 via a data bus 63 and a bus 71, which processor modifies, mixes, etc. the primary audio signals. Thus, it is provided with several inputs 65 and outputs 66 for audio signals. The signal processor 64 comprises the primary core of an audio mixer, e.g., operating digitally and thus known per se and not shown here. An algorithm library 67 is assigned to the signal processor 64, having saved all algorithms used in the processing of the signals from the entries 65. This library is connected to the signal processor 64 via a bus 69 and to the computer 62 via a bus 68.

Figure 8:
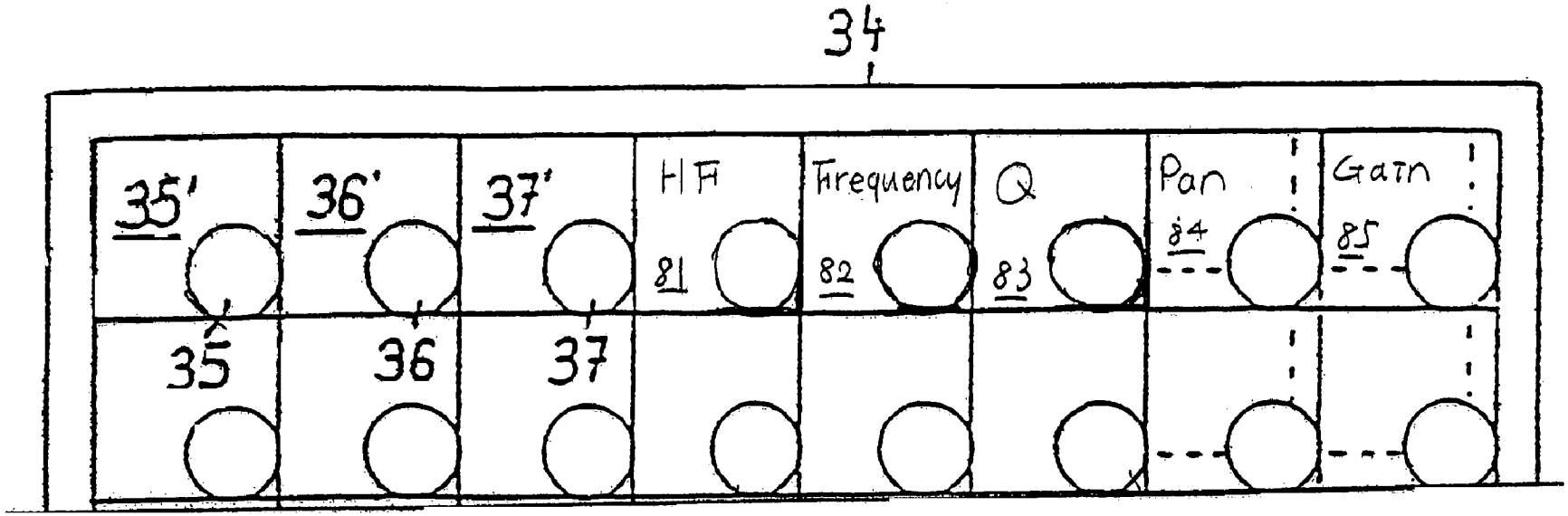
FIG. 8 a view of a device illustrating one exemplary configuration applied to multiple fields of a screen.
Figure 9:
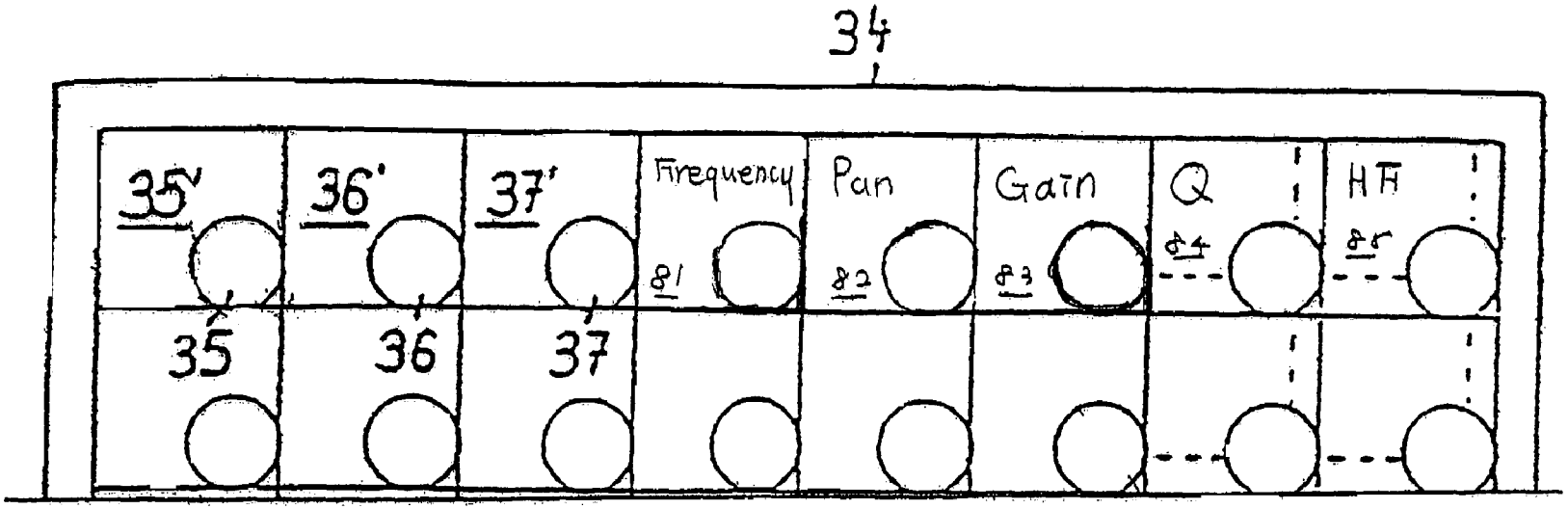
FIG. 9 a view of a device illustrating different exemplary configuration applied to the multiple fields of the screen of FIG. 8.

In an audio mixer of a known type, the operating surface 53 is connected directly to the process computer 64 via suitable means so that the operating elements 55, 56 can directly influence the processing of the signals for the exists 66. In order to create additional possibilities according to the invention for operating such an audio mixer, a computer 62 is connected between the operating surface 53 and the process computer 64 which protocols the state, i.e., all settings of the audio mixer and the signals pertaining thereto. FIGS. 8 and 9 illustrate two different exemplary configurations applied to multiple regions 81, 82, 83, 84 and 85 of the screen 34 of FIG. 5. In FIGS. 8 and 9, the configurations include HF, frequency, Q, Pan and Gain. In FIGS. 8 and 9, when the configuration of the switch board is changed by the operating elements 55, it occurs by means of corresponding data using the bus 59 to cause the computer 62, on the one hand, to select new algorithms via the bus 68 from the algorithm library 67 and to put them out to the signal processor 64 and, on the other hand, to direct the graphic computer 58 via the data bus 61 to adjust the displays, dials, etc. on the screen 57 to the new configuration. In FIGS. 8 and 9, the term configuration defines the entire arrangement provided for the processing of the audio signals. It can be represented in a block wiring diagram, for instance, which lists all processes, such as increases, additions of signals, filters, lever changes, etc. Such a block wiring diagram, being precisely equivalent to a configuration, can be modified by changes of the configuration so that a different block wiring diagram is valid for the processing, etc. If operating elements 56 are activated, however, the configuration (the block wiring diagram) remains unchanged and only the values of the parameters in the selected parameters are changed, transmitted by way of the bus 71 to the signal processor 64 and are displayed on the screen 57 via the graphic computer 58 as well.

Therefore, the computer 62 serves to acquire the state of signal paths, lever positions, filters, the dynamic of modifying processors, and the size of signals, the position and the change of the position of entering elements, etc. and to display them on the screen 57 in a suitable fashion. Additionally, it gives control commands to the signal processor 64 for processing audio and video signals. The user is also guided through this permanently updated display by making it discernible which modifications in different levels were caused by his intervention into the existing settings. For example, a modification of the frequency limit of a filter component causes not only the display of the new frequency limit but additionally the updated display of other values dependent on it, such as the lever, etc.

The operating elements 55 represent devices for defining the signal flux in the audio channels by selecting the algorithms. In the computer 62, stored program parts define means for determining the assignment of operating elements, for instance, in the meaning that a line or column of rotating knobs on the audio mixer serves to adjust equal parameters, with other parameters being influenced by elements of other lines or columns. This can also mean that singular operation elements can be blocked in a configuration and cannot cause any effect or that several parameters can be modified by a single operation element, e.g., by means of a serial approach. It can simply mean that the language of the labeling can be adjusted at the 49th position etc. or that in some sections of the display the color can be modified rhythmically or can be changed.

The invention claimed is:

1. A device for setting values for processing of audio signals, comprising:

a signal processor;

a screen connected with the signal processor for displaying the values, the screen comprising at least two fields;

a carrier for accommodating at least two operating elements, the carrier being located, relative to a viewing direction of the screen, in front of the screen;

the at least two operating elements structured and arranged for allowing the simultaneous adjustment of the values displayed in the at least two fields on the screen, each operating element disposed adjacent one of the displayed values within each field;

a computer coupled to the at least two operating elements via connections in front of the screen, the computer being structured and arranged to acquire the adjusted values and to drive the screen to display the acquired value on at least one of the fields of the screen, wherein the computer is operable to assign different configurations to at least one of the fields of the screen in accordance with one of the at least two operating elements wherein the at least one of the fields of the screen displays a different type of value in response to the assigned configurations; and the computer being coupled to the signal processor for the processing of audio signals and structured and arranged to transmit control commands to the signal processor for processing the audio signals according to the manually adjusted values established by the at least two operating elements.

2. The device in accordance with claim 1, wherein set values of the manually adjusted values depend upon a position of the at least two operating elements.

3. The device in accordance with claim 1, wherein the carrier includes transparent regions assigned to the at least two operating elements.

4. The device in accordance with claim 1, wherein the computer determines a configuration for the processing of the audio signals in the signal processor.

5. The device in accordance with claim 1, wherein a device for mounting electronic components is positioned between the carrier and the screen for mounting electronic components.

6. The device in accordance with claim 5, wherein the device for mounting electronic components is positioned on the carrier.

7. The device in accordance with claim 1, wherein the at least two operating elements include at least one shaft encoder.

8. The device in accordance with claim 1, wherein the at least two operating elements include at least one linearly adjustable transmitter.

9. The device in accordance with claim 1, wherein the computer is structured and arranged to determine a configuration of the device by detecting positions of the at least two operating elements.

10. The device in accordance with claim 1, further comprising additional elements which are different from the at least two operating elements are associated with the screen.

11. The device in accordance with claim 1, wherein the computer is structured and arranged to acquire states of the at least two operating elements via signals in the fields of the screen and to display these states on the screen.

12. The device in accordance with claim 11, wherein the acquired states include signal paths, lever positions, filters, dynamic changing processors, size of signals, position and variation of the position of the at least two operating elements.

13. The device in accordance with claim 1, wherein at least one of the at least two operating elements comprises an operating element structured and arranged for configuring an audio mixer.

14. The device in accordance with claim 1, wherein at least one of the at least two operating elements comprises an operating element structured and arranged for setting parameters for the processing of the audio signals.

15. An audio signal processing apparatus comprising:

an operating surface comprising at least two operating elements structured and arranged to simultaneously set at least two values related to at least one of configurations for processing audio signals and parameters for the processing of the audio signals;

at least one screen comprising at least two fields structured and arranged to display the set values of the at least two operating elements, each operating element disposed adjacent one of the displayed values within each field;

a computer, coupled to the at least two operating elements and to the at least one screen, structured and arranged to acquire the set values and transmit the set values to the at least one screen for display wherein the computer is operable to assign different configurations to at least one of the fields of the screen in accordance with one of the at least two operating elements wherein the at least one of the fields of the screen displays a different type of value in response to the assigned configurations;

a signal processor coupled to the computer, wherein the computer transmits the set values to the signal processor to adjust the processing of the audio signals by the signal processor; and an algorithm library coupled to the computer and to the signal processor.

16. The apparatus in accordance with claim 15, wherein at least one of the operating elements is structured and arranged to define a configuration for the processing of the audio signals.

17. The apparatus in accordance with claim 16, wherein at least one other of the operating elements is structured and arranged to adjust a value of at least one selected parameter without changing the configuration.

18. The apparatus in accordance with claim 15, the apparatus further comprising signal paths, positionable levers, filters, modifying processors, and the computer being structured and arranged to acquire data related to states of the signal paths, lever positions, states of the filters, dynamics of the modifying processors, amplitudes of the audio signals, and current positions of the at least two operating elements, and to transmit this data to the at least one screen for display.

19. The apparatus in accordance with claim 15, further comprising a graphic computer arranged to couple the computer to the at least one screen.

20. The apparatus in accordance with claim 16, wherein the computer is operable to select a new algorithm from the algorithm library and the new algorithm is selected based on the configuration defined by the at least one of the operating elements.

21. The apparatus in accordance with claim 20, wherein the computer is operable to transmit the new algorithm to the signal processor.

22. The apparatus in accordance with claim 16, wherein the computer is operable to drive the screen to adjust and/or change the display in accordance with the configuration.

* * * * *